US007235161B2

(12) United States Patent
DiMilia et al.

(10) Patent No.: US 7,235,161 B2
(45) Date of Patent: Jun. 26, 2007

(54) STABLE ANODES INCLUDING IRON OXIDE AND USE OF SUCH ANODES IN METAL PRODUCTION CELLS

(75) Inventors: Robert A. DiMilia, Greensburg, PA (US); Xinghua Liu, Murrysville, PA (US); Douglas A. Weirauch, Jr., Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 476 days.

(21) Appl. No.: 10/716,973

(22) Filed: Nov. 19, 2003

(65) Prior Publication Data

US 2005/0103641 A1 May 19, 2005

(51) Int. Cl.
*C25C 7/02* (2006.01)
*C25C 3/12* (2006.01)

(52) U.S. Cl. ..... 204/291; 204/293; 205/387

(58) Field of Classification Search ..... None
See application file for complete search history.

(56) References Cited

U.S. PATENT DOCUMENTS

| | | | | |
|---|---|---|---|---|
| 3,711,397 | A * | 1/1973 | Martinsons | 204/291 |
| 3,930,967 | A | 1/1976 | Alder | 204/67 |
| 3,960,678 | A | 6/1976 | Alder | 204/67 |
| 4,057,480 | A | 11/1977 | Alder | 204/290 R |
| 4,187,155 | A | 2/1980 | de Nora et al. | 204/67 |
| 4,374,050 | A | 2/1983 | Ray | 252/519 |
| 4,374,761 | A | 2/1983 | Ray | 252/519 |
| 4,399,008 | A | 8/1983 | Ray | 204/67 |
| 4,411,761 | A * | 10/1983 | Roos et al. | 204/291 |
| 4,455,211 | A | 6/1984 | Ray et al. | 204/293 |
| 4,478,693 | A | 10/1984 | Ray | 204/64 R |
| 4,515,674 | A | 5/1985 | Takahashi | 204/292 |
| 4,582,585 | A | 4/1986 | Ray | 204/243 R |
| 4,584,172 | A | 4/1986 | Ray et al. | 419/34 |
| 4,620,905 | A | 11/1986 | Tarcy et al. | 204/64 R |
| 4,764,257 | A | 8/1988 | Sadoway | 204/1 T |
| 5,019,225 | A | 5/1991 | Darracq et al. | 204/67 |
| 5,118,824 | A | 6/1992 | Paumard et al. | 556/14 |
| 5,279,715 | A | 1/1994 | La Camera et al. | 204/64 R |
| 5,284,562 | A | 2/1994 | Beck et al. | 204/243 R |
| 5,378,325 | A | 1/1995 | Dastolfo, Jr. et al. | 204/66 |

(Continued)

FOREIGN PATENT DOCUMENTS

| | | |
|---|---|---|
| EP | 0 093174 A | 8/1982 |

(Continued)

OTHER PUBLICATIONS

Belyav et al., "Electrolysis o f Alumina with Nonconsumable Anodes of Oxides," Laboratory of Electrometallurgiya of Nonferrous Metals, Ministry of Nonferrous Metallurgy and of Gold, Dec. 28, 1936, pp. 1-21 (translated from Russian).

*Primary Examiner*—Harry D. Wilkins, III
(74) *Attorney, Agent, or Firm*—Greenberg Traurig, LLP

(57) ABSTRACT

Stable anodes comprising iron oxide useful for the electrolytic production of metal such as aluminum are disclosed. The iron oxide may comprise $Fe_3O_4$, $Fe_2O_3$, FeO or a combination thereof. During the electrolytic aluminum production process, the anodes remain stable at a controlled bath temperature of the aluminum production cell and current density through the anodes is controlled. The iron oxide-containing anodes may be used to produce commercial purity aluminum.

16 Claims, 1 Drawing Sheet

U.S. PATENT DOCUMENTS

| | | | | |
|---|---|---|---|---|
| 5,415,742 | A | 5/1995 | La Camera et al. | 204/1.11 |
| 5,794,112 | A | 8/1998 | Ray et al. | 419/21 |
| 5,865,980 | A | 2/1999 | Ray et al. | 205/367 |
| 6,030,518 | A | 2/2000 | Dawless et al. | 205/387 |
| 6,126,799 | A | 10/2000 | Ray et al. | 204/291 |
| 6,217,739 | B1 | 4/2001 | Ray et al. | 205/385 |
| 6,248,227 | B1 | 6/2001 | de Nora et al. | 205/230 |
| 6,372,099 | B1 | 4/2002 | Duruz et al. | 204/245 |
| 6,372,119 | B1 | 4/2002 | Ray et al. | 205/387 |
| 6,416,649 | B1 | 7/2002 | Ray et al. | 205/387 |
| 6,423,195 | B1 | 7/2002 | Ray et al. | 204/291 |
| 6,423,204 | B1 | 7/2002 | Ray et al. | 205/387 |
| 6,436,274 | B2 | 8/2002 | De Nora et al. | 205/384 |
| 6,521,115 | B2 | 2/2003 | Duruz et al. | 205/387 |
| 6,521,116 | B2 | 2/2003 | Duruz et al. | 205/387 |
| 6,533,909 | B2 | 3/2003 | Duruz et al. | 204/243.1 |
| 6,913,682 | B2 | 7/2005 | Duruz et al. | 205/387 |
| 2001/0020590 | A1* | 9/2001 | Duruz et al. | 205/333 |
| 2006/0011490 | A1* | 1/2006 | Nguyen et al. | 205/372 |

FOREIGN PATENT DOCUMENTS

| | | | |
|---|---|---|---|
| GB | 1433805 | * | 4/1976 |
| JP | 50-062114 A | * | 5/1975 |
| WO | WO 01/32961 | | 5/2001 |
| WO | WO 03/078695 A | | 9/2003 |
| WO | WO 03/087435 A2 | | 10/2003 |
| WO | WO 2004/02994 A | | 3/2004 |
| WO | WO 2004/024994 A1 | | 3/2004 |

* cited by examiner

STABLE ANODES INCLUDING IRON OXIDE AND USE OF SUCH ANODES IN METAL PRODUCTION CELLS

FIELD OF THE INVENTION

The present invention relates to stable anodes useful for the electrolytic production of metal, and more particularly relates to stable, oxygen-producing anodes comprising iron oxide for use in low temperature aluminum production cells.

BACKGROUND OF THE INVENTION

The energy and cost efficiency of aluminum smelting can be significantly reduced with the use of inert, non-consumable and dimensionally stable anodes. Replacement of traditional carbon anodes with inert anodes should allow a highly productive cell design to be utilized, thereby reducing capital costs. Significant environmental benefits are also possible because inert anodes produce no $CO_2$ or $CF_4$ emissions. Some examples of inert anode compositions are provided in U.S. Pat. Nos. 4,374,050, 4,374,761, 4,399,008, 4,455,211, 4,582,585, 4,584,172, 4,620,905, 5,794,112, 5,865,980, 6,126,799, 6,217,739, 6,372,119, 6,416,649, 6,423,204 and 6,423,195, assigned to the assignee of the present application. These patents are incorporated herein by reference.

A significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not enter into unwanted reactions with oxygen or corrode in an oxygen-containing atmosphere. It should be thermally stable and should have good mechanical strength. Furthermore, the anode material must have sufficient electrical conductivity at the smelting cell operating temperatures so that the voltage drop at the anode is low and stable during anode service life.

SUMMARY OF THE INVENTION

The present invention provides a stable, inert anode comprising iron oxide(s) such as magnetite ($Fe_3O_4$), hematite ($Fe_2O_3$) and wüstite (FeO) for use in electrolytic metal production cells such as aluminum smelting cells. The iron oxide-containing anode possesses good stability, particularly at controlled cell operation temperatures below about 960° C.

An aspect of the present invention is to provide a method of making aluminum. The method includes the steps of passing current between a stable anode comprising iron oxide and a cathode through a bath comprising an electrolyte and aluminum oxide, maintaining the bath at a controlled temperature, controlling current density through the anode, and recovering aluminum from the bath.

Another aspect of the present invention is to provide a stable anode comprising iron oxide for use in an electrolytic metal production cell.

A further aspect of the present invention is to provide an electrolytic aluminum production cell comprising a molten salt bath including an electrolyte and aluminum oxide maintained at a controlled temperature, a cathode, and a stable anode comprising iron oxide.

These and other aspects of the present invention will be more apparent from the following description.

DETAILED DESCRIPTION OF THE PREFERRED EMBODIMENTS

Figure 1:
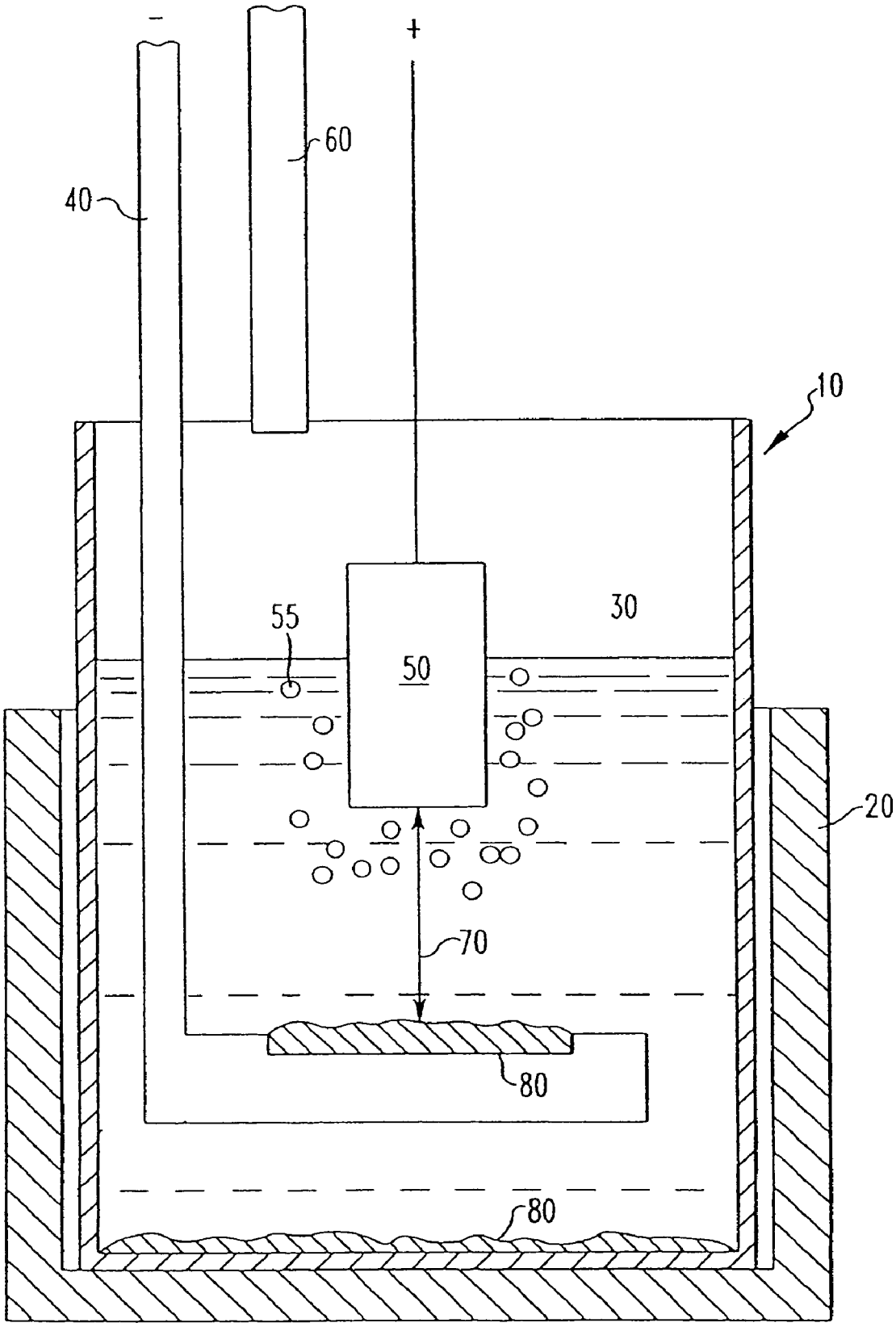
FIG. 1 is a partially schematic sectional view of an electrolytic cell including a stable anode comprising iron oxide in accordance with the present invention.

FIG. 1 schematically illustrates an electrolytic cell for the production of aluminum which includes a stable iron oxide anode in accordance with an embodiment of the present invention. The cell includes an inner crucible 10 inside a protection crucible 20. A cryolite bath 30 is contained in the inner crucible 10, and a cathode 40 is provided in the bath 30. An iron oxide-containing anode 50 is positioned in the bath 30. During operation of the cell, oxygen bubbles 55 are produced near the surface of the anode 50. An alumina feed tube 60 extends partially into the inner crucible 10 above the bath 30. The cathode 40 and the stable anode 50 are separated by a distance 70 known as the anode-cathode distance (ACD). Aluminum 80 produced during a run is deposited on the cathode 40 and on the bottom of the crucible 10. Alternatively, the cathode may be located at the bottom of the cell, and the aluminum produced by the cell forms a pad at the bottom of the cell.

As used herein, the term "stable anode" means a substantially non-consumable anode which possesses satisfactory corrosion resistance, electrical conductivity, and stability during the metal production process. The stable anode may comprise a monolithic body of the iron oxide material. Alternatively, the stable anode may comprise a surface layer or coating of the iron oxide material on the inert anode. In this case, the substrate material of the anode may be any suitable material such as metal, ceramic and/or cermet materials.

As used herein, the term "commercial purity aluminum" means aluminum which meets commercial purity standards upon production by an electrolytic reduction process. The commercial purity aluminum preferably comprises a maximum of 0.5 weight percent Fe. For example, the commercial purity aluminum comprises a maximum of 0.4 or 0.3 weight percent Fe. In one embodiment, the commercial purity aluminum comprises a maximum of 0.2 weight percent Fe. The commercial purity aluminum may also comprise a maximum of 0.034 weight percent Ni. For example, the commercial purity aluminum may comprise a maximum of 0.03 weight percent Ni. The commercial purity aluminum may also meet the following weight percentage standards for other types of impurities: 0.1 maximum Cu, 0.2 maximum Si, 0.030 maximum Zn and 0.03 maximum Co. For example, the Cu impurity level may be kept below 0.034 or 0.03 weight percent, and the Si impurity level may be kept below 0.15 or 0.10 weight percent. It is noted that for every numerical range or limit set forth herein, all numbers with the range or limit including every fraction or decimal between its stated minimum and maximum, are considered to be designated and disclosed by this description.

At least a portion of the stable anode of the present invention preferably comprises at least about 50 weight percent iron oxide, for example, at least about 80 or 90 weight percent. In a particular embodiment, at least a portion of the anode comprises at least about 95 weight percent iron oxide. In one embodiment, at least a portion of the anode is entirely comprised of iron oxide. The iron oxide component may comprise from zero to 100 weight percent magnetite, from zero to 100 weight percent hematite, and from zero to 100 weight percent wüstite, preferably zero to 50 weight percent wüstite.

The iron oxide anode material may optionally include other materials such as additives and/or dopants in amounts up to about 90 weight percent. In one embodiment, the additive(s) and/or dopant(s) may be present in relatively minor amounts, for example, from about 0.1 to about 10 weight percent. Alternatively, the additives may be present in greater amounts up to about 90 weight percent. Suitable metal additives include Cu, Ag, Pd, Pt, Ni, Co, Fe and the like. Suitable oxide additives or dopants include oxides of Al, Si, Ca, Mn, Mg, B, P, Ba, Sr, Cu, Zn, Co, Cr, Ga, Ge, Hf, In, Ir, Mo, Nb, Os, Re, Rh, Ru, Se, Sn, Ti, V, W, Zr, Li, Ce, Y and F, e.g., in amounts of up to about 90 weight percent or higher. For example, the additives and dopants may include oxides of Al, Si, Ca, Mn and Mg in total amounts up to 5 or 10 weight percent. Such oxides may be present in crystalline form and/or glass form in the anode. The dopants may be used, for example, to increase the electrical conductivity of the anode, stabilize electrical conductivity during operation of the Hall cell, improve performance of the cell and/or serve as a processing aid during fabrication of the anodes.

The additives and dopants may be included with, or added as, starting materials during production of the anodes. Alternatively, the additives and dopants may be introduced into the anode material during sintering operations, or during operation of the cell. For example, the additives and dopants may be provided from the molten bath or from the atmosphere of the cell.

The iron oxide anodes may be formed by techniques such as powder sintering, sol-gel processes, chemical processes, co-precipitation, slip casting, fuse casting, spray forming and other conventional ceramic or refractory forming processes. The starting materials may be provided in the form of oxides, e.g., $Fe_3O_4$, $Fe_2O_3$ and FeO. Alternatively, the starting materials may be provided in other forms, such as nitrates, sulfates, oxylates, carbonates, halides, metals and the like. In one embodiment, the anodes are formed by powder techniques in which iron oxide powders and any other optional additives or dopants are pressed and sintered. The resultant material may comprise iron oxide in the form of a continuous or interconnected material. The anode may comprise a monolithic component of such materials, or may comprise a substrate having at least one coating or layer of the iron oxide-containing material.

The sintered anode may be connected to a suitable electrically conductive support member within an electrolytic metal production cell by means such as welding, brazing, mechanically fastening, cementing and the like. For example, the end of a conductive rod may be inserted in a cup-shaped anode and connected by means of sintered metal powders and/or small spheres of copper or the like which fill the gap between the rod and the anode.

During the metal production process of the present invention, electric current from any standard source is passed between the stable anode and a cathode through a molten salt bath comprising an electrolyte and an oxide of the metal to be collected, while controlling the temperature of the bath and the current density through the anode. In a preferred cell for aluminum production, the electrolyte comprises aluminum fluoride and sodium fluoride and the metal oxide is alumina. The weight ratio of sodium fluoride to aluminum fluoride is about 0.5 to 1.2, preferably about 0.7 to 1.1. The electrolyte may also contain calcium fluoride, lithium fluoride and/or magnesium fluoride.

In accordance with the present invention, the temperature of the bath of the electrolytic metal production cell is maintained at a controlled temperature. The cell temperature is thus maintained within a desired temperature range below a maximum operating temperature. For example, the present iron oxide anodes are particularly useful in electrolytic cells for aluminum production operated at temperatures in the range of about 700-960° C., e.g., about 800 to 950° C. A typical cell operates at a temperature of about 800-930° C., for example, about 850-920° C. Above these temperature ranges, the purity of the produced aluminum decreases significantly.

The iron oxide anodes of the present invention have been found to possess sufficient electrical conductivity at the operation temperature of the cell, and the conductivity remains stable during operation of the cell. For example, at a temperature of 900° C., the electrical conductivity of the iron oxide anode material is preferably greater than about 0.25 S/cm, for example, greater than about 0.5 S/cm. When the iron oxide material is used as a coating on the anode, an electrical conductivity of at least 1 S/cm may be particularly preferred.

In accordance with an embodiment of the present invention, during operation of the metal production cell, current density through the anodes is controlled. Current densities of from 0.1 to 6 Amp/cm$^2$ are preferred, more preferably from 0.25 to 2.5 Amp/cm$^2$.

The following examples describe press sintering, fuse casting and castable processes for making iron oxide anode materials in accordance with embodiments of the present invention.

EXAMPLE 1

In the press sintering process, the iron oxide mixture may be ground, for example, in a ball mill to an average particle size of less than 10 microns. The fine iron oxide particles may be blended with a polymeric binder/plasticizer and water to make a slurry. About 0.1-10 parts by weight of an organic polymeric binder may be added to 100 parts by weight of the iron oxide particles. Some suitable binders include polyvinyl alcohol, acrylic polymers, polyglycols, polyvinyl acetate, polyisobutylene, polycarbonates, polystyrene, polyacrylates, and mixtures and copolymers thereof. Preferably, about 0.8-3 parts by weight of the binder are added to 100 parts by weight of the iron oxide. The mixture of iron oxide and binder may optionally be spray dried by forming a slurry containing, e.g., about 60 weight percent solids and about 40 weight percent water. Spray drying of the slurry may produce dry agglomerates of the iron oxide and binders. The iron oxide and binder mixture may be pressed, for example, at 5,000 to 40,000 psi, into anode shapes. A pressure of about 30,000 psi is particularly suitable for many applications. The pressed shapes may be sintered in an oxygen-containing atmosphere such as air, or in argon/oxygen, nitrogen/oxygen, $H_2/H_2O$ or $CO/CO_2$ gas mixtures, as well as nitrogen. Sintering temperatures of about 1,000-1,400° C. may be suitable. For example, the furnace may be operated at about 1,250-1,350° C. for 2-4 hours. The sintering process burns out any polymeric binder from the anode shapes.

EXAMPLE 2

In the fuse casting process, anodes may be made by melting iron oxide raw materials such as ores in accordance with standard fuse casting techniques, and then pouring the melted material into fixed molds. Heat is extracted from the molds, resulting in a solid anode shape.

EXAMPLE 3

In the castable process, the anodes may be produced from iron oxide aggregate or powder mixed with bonding agents. The bonding agent may comprise, e.g., a 3 weight percent addition of activated alumina. Other organic and inorganic bonding phases may be used, such as cements or combinations of other rehydratable inorganics and as well as organic binders. Water and organic dispersants may be added to the dry mix to obtain a mixture with flow properties characteristic of vibratable refractory castables. The material is then added to molds and vibrated to compact the mixture. The mixtures are allowed to cure at room temperature to solidify the part. Alternately, the mold and mixture may be heated to elevated temperatures of 60-95° C. to further accelerate the curing process. Once cured, the cast material is removed from the mold and sintered in a similar manner as described in Example 1.

Iron oxide anodes were prepared comprising $Fe_3O_4$, $Fe_2O_3$, FeO or combinations thereof in accordance with the procedures described above having diameters of about 2 to 3.5 inch and lengths of about 6 to 9 inches. The anodes were evaluated in a Hall-Heroult test cell similar to that schematically illustrated in FIG. 1. The cell was operated for a minimum of 100 hours at temperatures ranging from 850 to 1,000° C. with an aluminum fluoride to sodium fluoride bath weight ratio of from 0.5 to 1.25 and alumina concentration maintained between 70 and 100 percent of saturation.

Table 1 lists anode compositions, cell operating temperatures, run times and impurity levels of Fe, Ni, Cu, Zn, Mg, Ca and Ti in the produced aluminum from each cell.

TABLE 1

| | Run # | | | | | |
|---|---|---|---|---|---|---|
| | 1 | 2 | 3 | 4 | 5 | 6 |
| Anode Composition | Fuse-cast magnetite with 5 wt % glass | Pressed and sintered magnetite and wüstite | Pressed and sintered magnetite and wüstite | Pressed and sintered hematite | Pressed and sintered magnetite | Pressed and sintered magnetite |
| Temperature | 900 C. | 900 C. | 900 C. | 900 C. | 900 C. | 1000 C. |
| Run time | 100 hr | 100 hr | 350 hr | 120 hr | 350 hr | 100 hr |
| Fe (wt %) | 0.16 | 0.16 | 0.2 | 0.25 | 0.32 | 5.73 |
| Ni (wt %) | <0.001 | 0.002 | <0.001 | <0.001 | <0.001 | 0.003 |
| Cu (wt %) | <0.001 | <0.001 | <0.001 | <0.001 | <0.001 | <0.001 |
| Zn (wt %) | <0.001 | <0.001 | <0.001 | <0.001 | <0.001 | 0.003 |
| Mg (wt %) | <0.001 | 0.002 | 0.001 | 0.002 | <0.001 | <0.001 |
| Ca (wt %) | 0.002 | 0.032 | 0.041 | 0.024 | 0.002 | 0.001 |
| Ti (wt %) | 0.002 | 0.003 | 0.014 | 0.009 | 0.02 | 0.022 |

As shown in Table 1, at bath temperatures on the order of 900° C. iron oxide anodes of the present invention produce aluminum with low levels of iron impurities, as well as low levels of other impurities. Iron impurity levels are typically less than about 0.2 or 0.3 weight percent. In contrast, the iron impurity level for the cell operated at 1,000° C. is more than an order of magnitude higher than the impurity levels of the lower temperature cells. In accordance with the present invention, cells operated at temperatures below 960° C. have been found to produce significantly lower iron impurities in the produced aluminum. Furthermore, Ni, Cu, Zn and Mg impurity levels are typically less than 0.001 weight percent each. Total Ni, Cu, Zn, Mg, Ca and Ti impurity levels are typically less than 0.05 weight percent.

Having described the presently preferred embodiments, it is to be understood that the invention may be otherwise embodied within the scope of the appended claims.

What is claimed is:

1. A stable anode for use in an electrolytic aluminum production cell, the stable anode comprising a monolithic body entirely composed of $Fe_3O_4$ and FeO.

2. The stable anode of claim 1, wherein the anode remains stable in a molten bath of an electrolytic aluminum production cell at a temperature of up to 960° C.

3. An electrolytic aluminum production cell including a plurality of the stable anodes of claim 1.

4. The electrolytic aluminum production cell of claim 3, wherein the electrolytic aluminum production cell contains a cryolite bath and wherein the electrolytic cell is operable to produce commercial purity aluminum utilizing the plurality of stable anodes, wherein the commercial purity aluminum contains a maximum of 0.5 weight percent iron.

5. The electrolytic aluminum production cell of claim 4, wherein the electrolytic aluminum production cell is operable at temperatures of from about 850° C. to about 920° C. to produce the commercial purity aluminum.

6. The electrolytic aluminum production cell of claim 5, wherein the commercial purity aluminum contains a maximum of 0.034 weight percent Ni, a maximum of 0.034 weight percent Cu, and a maximum of 0.15 weight percent Si.

7. A stable anode for use in an electrolytic aluminum production cell, the stable anode comprising a monolithic body enterely composeed of $Fe_3O_4$ and FeO and up to up to 10 wt % of an additive, wherein the additive is an oxide of one of Al, Si, and Mg.

8. The stable anode of claim 7, wherein the stable anode comprises up to 5 wt % of an additive, wherein the additive is an oxide of one of Al, Si, and Mg.

9. A stable anode for use in an electrolytic aluminum production cell, the stable anode comprising a monolithic body entirely composed of $Fe_2O^3$ and FeO.

10. The stable anode of claim 9, wherein the anode remains stable in a molten bath of an electrolytic aluminum production cell at a temperature of up to 960° C.

11. An electrolytic aluminum production cell including a plurality of the stable anodes of claim 9.

12. The electrolytic aluminum production cell of claim 11, wherein the electrolytic aluminum production cell contains a cryolite bath and wherein the electrolytic cell is operable to produce commercial purity aluminum utilizing the plurality of stable anodes, wherein the commercial purity aluminum contains a maximum of 0.5 weight percent iron.

13. The electrolytic aluminum production cell of claim 12, wherein the electrolytic aluminum production cell is operable at temperatures of from about 850° C. to about 920° C. to produce the commercial purity aluminum.

14. The electrolytic aluminum production cell of claim 13, wherein the commercial purity aluminum contains a maximum of 0.034 weight percent Ni, a maximum of 0.034 weight percent Cu, and a maximum of 0.15 weight percent Si.

15. A stable anode for use in an electrolytic aluminum production cell, the stable anode comprising a monolithic body entirely composed of $Fe_3O_4$ and FeO and up to 10 wt % of an additive, wherein the additive is an oxide of one of Al, Si, and Mg.

16. The stable anode of claim 15, wherein the stable anode comprises up to 5 wt % of an additive, wherein the additive is an oxide of one of Al, Si, and Mg.

* * * * *

UNITED STATES PATENT AND TRADEMARK OFFICE

CERTIFICATE OF CORRECTION

PATENT NO. : 7,235,161 B2
APPLICATION NO. : 10/716973
DATED : June 26, 2007
INVENTOR(S) : Robert A. DiMilia It is certified that error appears in the above-identified patent and that said Letters Patent is hereby corrected as shown below:

Please replace claim 15 Col. 8 lines 4-8 with the following corrected claim 15:

--15. A stable anode for use in an electrolytic aluminum production cell, the stable anode comprising a monolithic body entirely composed of $Fe_2O_3$ and FeO and up to 10 wt % of an additive, wherein the additive is an oxide of one of Al, Si, and Mg.--

Signed and Sealed this

Twenty-second Day of September, 2009

David J. Kappos

David J. Kappos
*Director of the United States Patent and Trademark Office*